US006824009B2

(12) United States Patent
Hardy

(10) Patent No.: US 6,824,009 B2
(45) Date of Patent: Nov. 30, 2004

(54) MERCHANDISE SELF-FACING SYSTEM WITH INTERLOCKING PUSHERS

(75) Inventor: Stephen Neal Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 95 days.

(21) Appl. No.: 10/248,881

(22) Filed: Feb. 26, 2003

(65) Prior Publication Data

US 2003/0094462 A1 May 22, 2003

(51) Int. Cl.[7] ..... B65G 59/00

(52) U.S. Cl. ..... 221/124; 211/59.3; 211/175; 211/184; 221/241; 221/279

(58) Field of Search ..... 211/59.3, 175, 211/184; 221/92, 124, 241, 242, 279

(56) References Cited

U.S. PATENT DOCUMENTS

| | | | | | |
|---|---|---|---|---|---|
| 181,834 | A | * | 9/1876 | Goehring | 312/71 |
| 3,110,402 | A | * | 11/1963 | Mogulescu | 211/59.3 |
| 4,008,828 | A | | 2/1977 | Branchaud | |
| 4,830,201 | A | | 5/1989 | Breslow | |
| 5,012,936 | A | | 5/1991 | Crum | |
| 5,131,563 | A | | 7/1992 | Yablans | |
| 5,190,186 | A | | 3/1993 | Yablans et al. | |
| 5,730,320 | A | | 3/1998 | David | |
| 6,067,670 | A | | 5/2000 | Eddy et al. | |
| 6,302,293 | B1 | * | 10/2001 | Wittern et al. | 221/92 |
| 6,382,431 | B1 | | 5/2002 | Burke | |
| 6,409,027 | B1 | * | 6/2002 | Chang et al. | 211/59.3 |
| 6,464,089 | B1 | * | 10/2002 | Rankin, VI | 211/59.3 |
| 6,484,891 | B2 | | 11/2002 | Burke | |
| 2002/0088762 | A1 | | 7/2002 | Burke | |

* cited by examiner

*Primary Examiner*—Richard Ridley
(74) *Attorney, Agent, or Firm*—Banner & Witcoff, Ltd.

(57) ABSTRACT

A self-facing merchandise pusher system for use in retail stores. Numerous products in a retail store are merchandised on shelves and a biased pusher is used to urge products toward the front edge of the shelf. The width of the pusher corresponds generally to the width of the narrowest product to be pushed. A removable divider extends vertically between each pusher. When pushing products that are multiples of the width of the narrowest product, dividers may be removed to create a larger pushing surface. Removing a divider locks two adjacent pushers together thereby causing the two pushers to push in unison and prevents product from slipping between the adjacent pushers.

20 Claims, 8 Drawing Sheets

MERCHANDISE SELF-FACING SYSTEM WITH INTERLOCKING PUSHERS

BACKGROUND OF INVENTION

1. Field of the Invention

The invention relates to a self-facing merchandise pusher system for use in retail stores.

2. Description of Related Art

Many types of products in a retail store are merchandised on shelves and can be pushed to the front of the shelf, toward the aisle, by a spring-urged pusher system that attaches to or is placed on the shelf. The pushing function serves to keep the product "front faced" at the front shelf edge so that the product is easier for the consumer to see, presents an organized, neater appearance, and makes restocking of the product easier for store personnel. Certain types of product packages, particularly tall, skinny packages, such as toothbrushes, are good candidates for a spring-urged pushing system because these products do not stand up well and require both restraining means and pushers so that the product can be effectively merchandised.

Known merchandising pusher systems, such as those disclosed in U.S. Pat. No. 5,730,320 to David and U.S. Pat. No. 5,131,563 to Yablans, include a segregated horizontal space, usually separated by product dividers, and a pusher between the dividers. The pushing surface on the pusher is generally a rigid vertical plane urged forward by a single spring. Typically, the pushing surface is oriented in a parallel manner to a fixed product retainer that resides at the front of the system, thereby keeping pushed product from spilling from the system. When merchandising certain products, such as toothbrushes, for example, the products are often sold in packaging that is a multiple of the width of the smallest single product. Consequently, in a retail store, it may be necessary to display many of each of several widths of product. As a result, a pusher system must accommodate these package widths and be flexible enough to allow changing of the positions of these products on the shelf without having to obtain and install different pusher components and without occupy ing a significant amount of time by store personnel. Currently, all known merchandise pusher systems are either limited to one package width or require additional components to be installed for other package sizes, as shown in U.S. Pat. No. 6,409,027 to Chang et al. The present invention is directed at overcoming these and other known problems.

SUMMARY OF INVENTION

The present invention is directed to a self-facing merchandise pusher system for use in displaying and dispensing product in retail stores. The invention incorporates biased pushers that are used to urge product toward the front edge of the retail shelf. The width of the pusher corresponds generally to the width of the narrowest product to be pushed. A removable divider extends vertically between each pusher. When pushing products of varying widths or multiples of the width of the narrowest product, dividers may be removed to create a larger pushing surface. Removing a divider causes a mechanism to interlock with an adjacent pusher thereby locking the two adjacent pushers together. Once interlocked, the adjacent pushers move in unison to urge larger width product toward the front edge of the retail shelf and also do not allow product to slip between the interlocked pushers. Likewise, replacing the divider causes the interlocking mechanism to retract from the adjacent pusher thereby unlocking the previously locked adjacent pushers and creating two independently movable pushers to dispense product.

DETAILED DESCRIPTION

Figure 1:
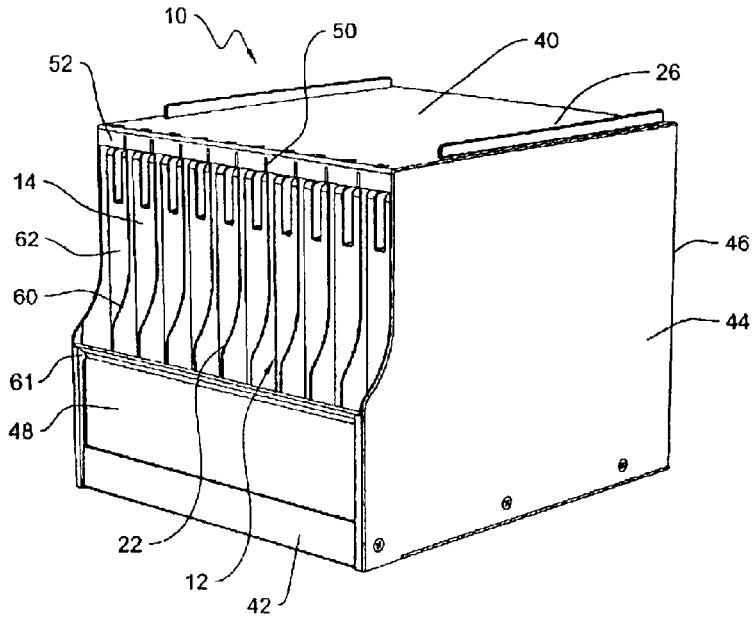
FIG. 1 shows an isometric view of the merchandise self-facing system of the present invention.
Figure 2:
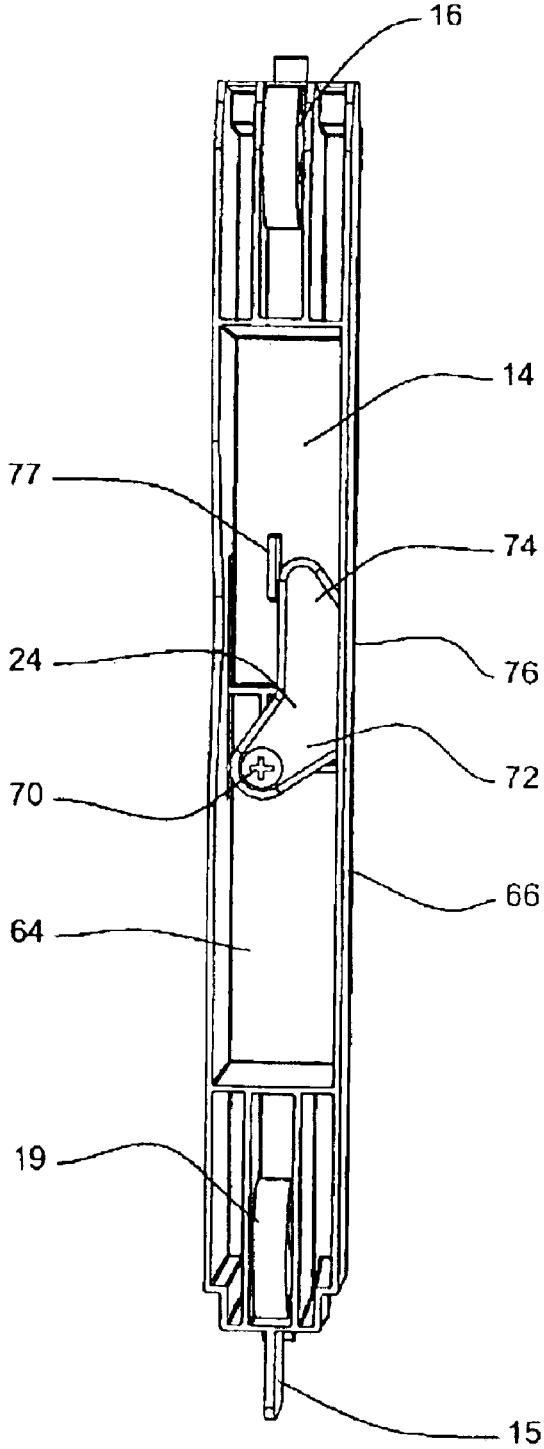
FIG. 2 shows a back elevation view of a pusher of the invention of FIG. 1.
Figure 3:
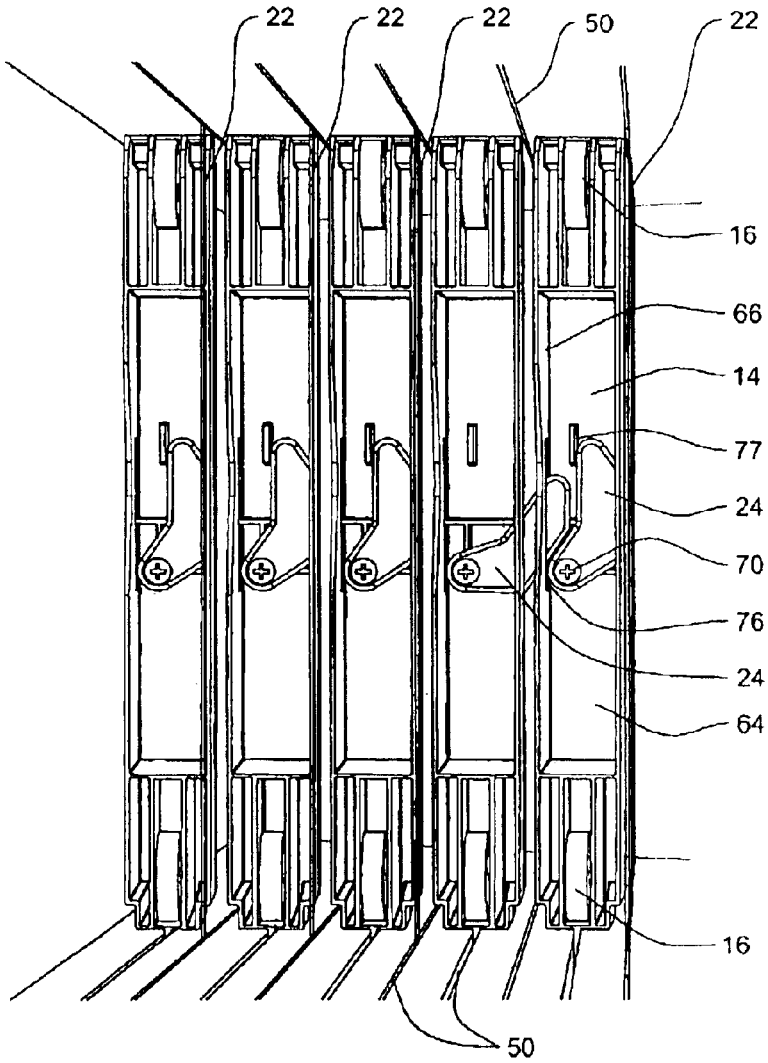
FIG. 3 shows a back elevation view of multiple pushers of the invention of FIG. 1.

The invention may be embodied in various forms. Referring to the Figures wherein like numerals indicate like elements, there is depicted in FIG. 1 an isometric view of the present invention. The invention allows the placement of merchandised product of any width, and any multiple of any width, at any position in the system with a simple operation.

As depicted, merchandise to be displayed and sold is contained in a box or housing 10 that may rest on or be attach ed to a retail shelf. Any known method of attaching or securing the housing 10 to the retail shelf may be used with the present invention. The housing 10 has a typical width of one or two feet, has a depth approximately the same depth of the shelf on which the housing is to be placed, and has a height approximately the height of the product to be merchandised. It should be apparent to those of skill in the art that the overall dimensions of the housing 10 will vary depending on the product merchandised and the constraints of the shelf on which the housing 10 is placed.

Referring to FIGS. 1 and 5–7, the box or housing 10 is divided into a plurality of product channels 12 with each product channel capable of containing individual product of the same or similar widths. While the Figures depict product channels 12 of equal width, product channels 12 of varying widths may be used with, and still be considered a part of, the present invention. The housing 10 includes a top wall 40, a bottom wall 42, opposing vertical side walls or panels 44, an open back wall 46, and a front product retaining wall or panel 48. The top and bottom walls 40, 42 are typically solid walls made of a suitable plastic or metal material that, depending on the application, may be modified or customized to permit mounting or fastening of the housing 10 onto a retail shelf. The top and bottom walls 40, 42 include a plurality of longitudinally extending slots 50 that extend the length of the walls 40, 42 and therefore the depth of the housing 10. The slots 50 receive and accommodate removable dividers 22, discussed below, that may be placed between the plurality of product channels 12 to separate the product being merchandised. The slots 50 may extend through the front 52 of the top wall 40 and also receive and accommodate the pushers 14, discussed below, for merchandising product. The slots 50 are sized and shaped to permit the slidable insertion and removal of the dividers 22 and pushers 14 from either the front or back of the housing 10. By removing some of the dividers, the width of the product channels 12 is changed to accommodate other sized products and product packaging.

It should be understood by those skilled in the art that variations to the top and bottom walls can be made to accommodate the insertion, placement, or removal of the dividers, variations that are still considered within the scope of the invention. For example, it may be desirable to reverse the structure that provides the slidable engagement of the dividers 22 with the slots 50 and still achieve an objective of the present invention. In other words, it may be desirable to place a slot in the end of the divider 22 that slidably engages a guide portion located in the top or bottom wall of the housing. This construction still permits the slidable insertion and removal of the dividers between the product channels.

As another example, it may be desirable to permit the insertion or removal of the dividers 22 through the top or bottom walls 40, 42 as opposed to the insertion or removal from the front or back of the housing. Under this scenario, the slots 50 may extend through the thickness of the wall of either the top or bottom walls 40, 42, or both. This modification will create an opening in the top or bottom walls 40, 42 to thus permit the slidable insertion and removal of the dividers 22. It may further be desirable to include a back ledge or similar structure on the back wall, or extending from the top or bottom walls, of the housing to serve as a stop and retaining means for the dividers and pushers that are slid along the slots 50. One of skill in the art should readily understand that other modifications may be made to the housing 10 or the walls to achieve an objective of the invention, namely, the insertion, placement, removal, and interchangeability of the dividers to permit the change of the product channel 12 widths to thereby accommodate varying sized products or product packaging.

One of skill in the art will further understand that while the slots 50 make the insertion and removal of the dividers a simple, easy operation, the invention contemplates systems that do not use slots. Rather, the dividers may simply be placed, anchored, fastened, secured or restrained by other techniques known in the art techniques that also permit the removal of the dividers. These techniques are also to be considered within the spirit and scope of the present invention.

As stated, the removable divider 22 may be placed between each product channel 12 and therefore between each pusher 14, described below. The divider 22 extends vertically from the top wall 40 to the bottom wall 42 and from the open back wall 46 to the front product retaining wall 48. The divider 22 separates merchandised product of adjacent product channels 12. The divider 22 is slidably removable from the housing. Because the invention may be stacked vertically, or placed adjacently, to increase the amount of product offered for sale, front or rear access to the divider is preferred. However, as stated, access to the divider from the top or bottom is possible with the present invention. The divider is preferably a clear plastic material that allows the product placed within the product channel 12 to be viewed by the consumer. The divider material should be sufficiently rigid to retain the product within the product channels 12.

As depicted in FIG. 1, depending on the product merchandised, the divider 22 may have a portion removed to permit the easy placement and removal of product within the housing 10. That is, as depicted, the divider 22 defines a sloped or curved edge 60 that extends rearward from a location adjacent the front product retaining wall 48 toward the back wall 46. The extent of the slope or curve may vary depending on the product displayed and merchandised. The sloped or curved edge 60 also serves to cause movement of the interlocking mechanism, discussed below. It should be understood that the sloped or curved edge may be located on both ends of the divider 22 to cause movement of the interlocking mechanism when the divider is inserted from either the front or back of the housing.

The opposing vertical side walls or panels 44 and the front product retaining wall 48 are typically solid walls made of a suitable plastic material, or other suitable material. The side walls 44 are generally sized and shaped to match the shape and contour of the removable dividers 22. Wall retaining tabs 61 extend outwardly from the side walls 44 and are used to connect and restrain the front product retaining wall 48 to the side walls 44. The retaining tabs 61 also permit the easy removal of the front product retaining wall 48 from the housing 10. It should be understood that other wall retaining tabs, or other techniques for retaining the front product retaining wall 48, may be used with the present invention.

Within each product channel 12 is a pusher 14 for biasing merchandised product toward the front product retaining wall 48 of the housing and therefore toward the front of the shelf on which the housing is placed. As should be apparent, the merchandised product is restrained between the pusher 14 and the front product retaining wall 48. Referring to FIGS. 1–4, the pusher 14 includes a front surface 62, back surface 64, and opposing side surfaces 66. The front surface 62 defines a rigid surface that, with the aid of the biasing mechanism 16, discussed below, urges the product toward the front product retaining wall 48. Mounted to the back surface 64 of the pusher 14 is an interlocking device or mechanism 24, preferably a pivoting mechanism, discussed below. Openings 76 are located in the side surfaces 66 of the pusher for receiving and securing the interlocking mechanism 24 from an adjacent pusher, thereby locking adjacent pushers together, as discussed below. The openings 76, preferably slots, are sized and shaped to receive the interlocking mechanism 24 therethrough.

Figure 8:
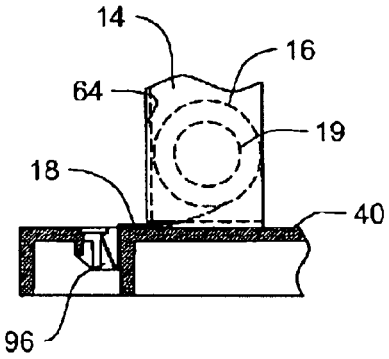
FIG. 8 shows a partial side elevation view of the connection of the pusher to the housing.
Figure 10:
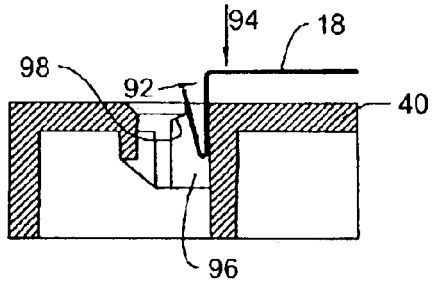
FIG. 10 shows another partial side elevation view of the assembly of FIG. 9.
Figure 11:
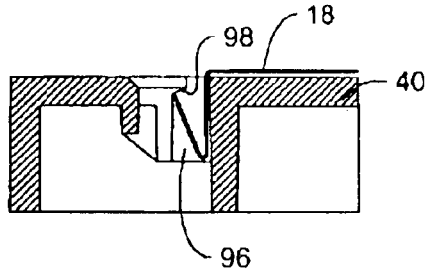
FIG. 11 shows another partial side elevation view of the assembly of FIG. 9.
Figure 12:
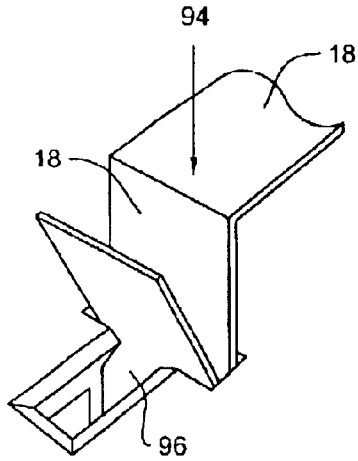
FIG. 12 shows an isometric view of the assembly of FIG. 9.
Figure 13:
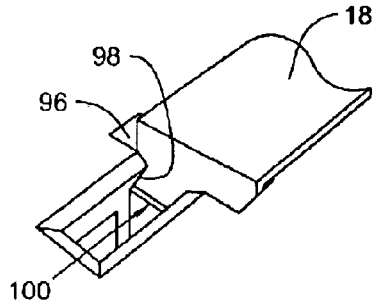
FIG. 13 shows an isometric view of the assembly of FIG. 11.

Each pusher 14 includes at its bottom end a downwardly extending fin 15 that slidably engages a slot 50 and is urged by a pair of biasing mechanisms 16, such as springs or other suitable resilient members. The biasing mechanism 16 is preferably a flat coil spring. As depicted in the exemplary embodiment, the biasing mechanism 16 has a secured end 18, shown in FIGS. 8–13, that attaches to either the top or bottom walls 40, 42 and a coiled extended end 19, shown in FIGS. 2, 3 and 8, that abuts the back surface 64 of the pusher 14. The biasing mechanism 16 may be located at both the top and bottom ends of the pusher 14. Placement at both ends permits the independent movement of each end of the pusher. With this mounting technique, the pushers effectively "float" between the top and bottom walls 40, 42 greatly reducing the likelihood of product not self-feeding toward the front of the housing 10. This mounting technique also makes the stocking of product an easy operation for store personnel and also permits varying shaped packaging to be placed with the product channels 12. While the flat coil spring is the preferred mechanism for biasing the pusher 14, other spring or biasing arrangements, and other spring mounted arrangements may be used with and should be considered to be within the spirit and scope of the present invention. For example, it is contemplated that the coiled end of the biasing mechansim can be connected to the housing through the use of a spool or similar device and the secured end can be connected to the pusher. This embodiment still maintains an object of the invention, namely, the independent movement of each end of the pusher.

Referring to FIGS. 8–13, the secured end 18 of the biasing mechanism 16 is shown being installed and secured to either of the bottom wall 40 or top wall 42 of the housing 10. In an exemplary embodiment, the secured end 18 of the biasing mechanism 16 is V-shaped and has a predetermined spring resiliency such that under an applied load, as indicated by arrow 92, the V-shaped end of the biasing mechanism 16 will compress and will return to its original shape upon the removal of the applied load. During installation of the biasing mechanism 16, by pressing down on the secured end 18 in the direction indicated by arrow 94, the V-shaped end of the biasing mechanism 16 compresses, as indicated by arrow 92, and releasably snaps into a channel 96 formed in the bottom wall 40 of the housing 10. Located within the channel 96 is a ledge 98 on which the V-shaped end 18 engages and prevents the secured V-shaped end 18 from releasing from the channel 96. To release the biasing mechanism 16 from the channel 96, one must simply apply a load on the V-shaped end 18, as indicated by arrow 100, until the V-shaped end 18 clears the ledge 98. The biasing mechanism may then be lifted up and out of the channel 96.

Figure 4:
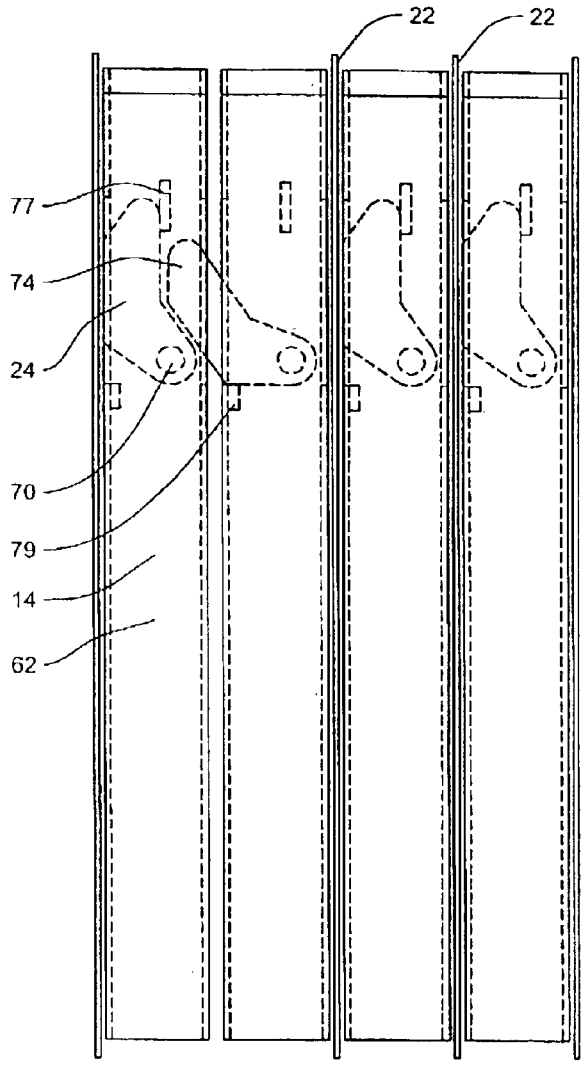
FIG. 4 shows a partial elevation view of the pus hers of the invention of FIG. 1.
Figure 5:
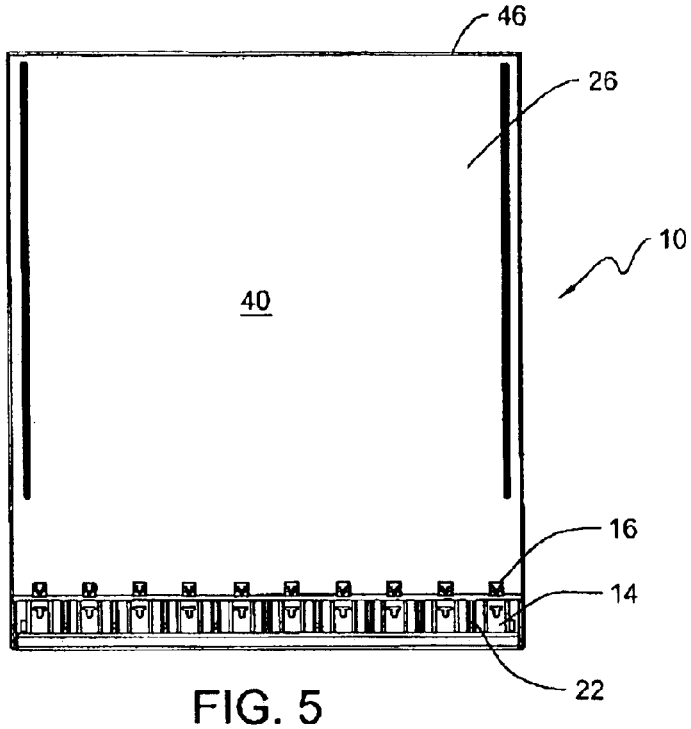
FIG. 5 shows a top plan view of the invention of FIG. 1.
Figure 6:
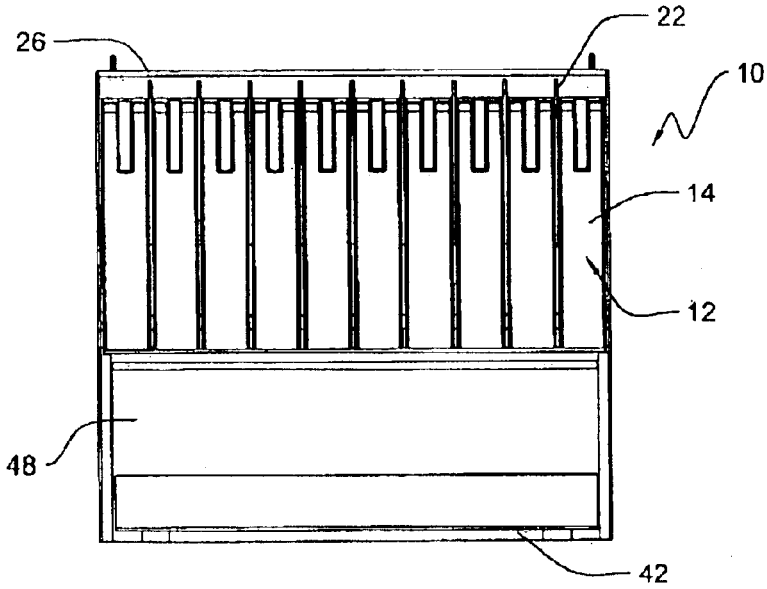
FIG. 6 shows a front elevation view of the invention of FIG. 1.
Figure 7:
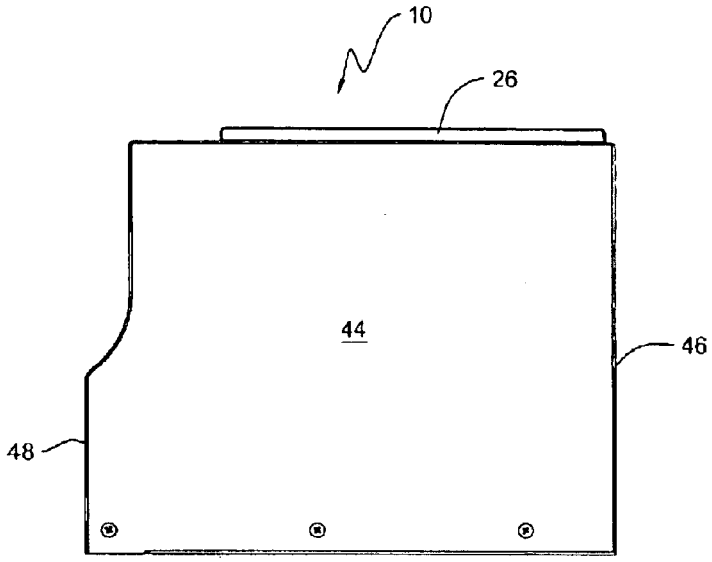
FIG. 7 shows a side elevation view of the invention of FIG. 1.
Figure 9:
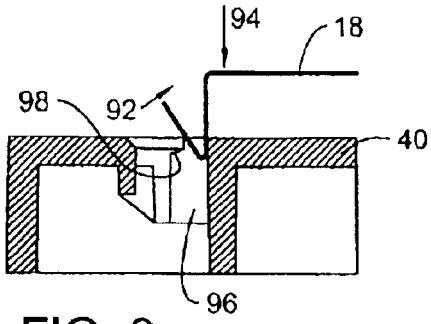
FIG. 9 shows a partial side elevation view of the installation of the biasing mechanism of the present invention.

Referring back to FIGS. 2–4, as stated, each pusher 14 may have attached to it an interlocking device 24, such as a pivoting mechanism, that can engage with an adjacent pusher when the divider 22 is removed and can disengage when the divider 22 is installed. The interlocking mechanism 24 is secured to the back surface 64 of the pusher by a fastener 70, or similar attachment means, and is either gravity-biased or spring-biased about the fastener 70. The interlocking mechanism 24 is depicted as being generally L-shaped and has a first end 72 rotatably mounted to the back surface 64 of the pusher 14, and a second free end 74 of a sufficient length to extend through an opening 76 located in the side surface 66 of an adjacent pusher and across the back surface 64 of the adjacent pusher. In a retracted position, the free end 74 of the interlocking mechanism 24 abuts a stop lug 77 that is positioned on the back surface 64 of the pusher 14. In an extended position, the free end 74 may rest on a second stop lug 79 that is also located on the back surface 64 of the pusher 14, as illustrated by FIG. 4. It should be understood that the fastener 70, or similar attachment means, along with the opening 76 permit the pusher to be adaptable with the interlocking mechanism of the present invention, or a similar interlocking technique.

In operation, upon the removal of a divider 22, the interlocking mechanism 24 of one pusher rotates about the fastener 70, which serves as pivot point, and the free end 74 of the interlocking mechanism 24 extends through the opening 76 and across the back surface of an adjacent pusher. The engagement of the interlocking mechanism 24 with the opening 76 effectively locks the adjacent pushers 14 together. Once locked, the adjacent pushers form a coherently moving pushing surface that is a multiple of the width of a single pusher. Stated another way, the action of slidably installing or removing the divider 22 automatically activates or deactivates the interlocking mechanism 24 with the opening 76, thereby locking or unlocking adjacent pushers 14. Significantly, with the present invention, no additional parts are required to vary the effective pushing width of the pushers. In addition, minimal effort is required to make the change in effective pushing width of the pushers.

One of skill in the art will understand that variations of the interlocking mechanism 24, opening 76, and the interlocking of adjacent pushers 14 exist. For example, the interlocking mechanism 24 may be a slidable latch that engages with an opening or aperture in an adjacent pusher. The interlocking mechanism may also include a hook for engaging a loop or pin on the adjacent pusher. Other embodiments and variations exist, such as the use of push pins, types of slidable clamps or fasteners, and the like, all of which are considered within the spirit of the invention because they achieve an object of the invention, namely, to lock and unlock adjacent pushers, without adding additional parts, to thereby permit the merchandising of various sized products and product packaging.

As depicted in FIG. 1, other benefits of the invention include a storage space or compartment 26 at the top of the housing 10 to store removed dividers 22 or the front product retaining wall 48.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A merchandise pusher system for self-facing product comprising:

a housing containing a plurality of product channels, the housing having a front and a back, a plurality of biased pushers positioned within the plurality of product channels for pushing product toward the front of the housing, at least one removable divider positioned between the plurality of biased pushers, and at least one interlocking device mounted to at least one of the plurality of biased pushers, the at least one interlocking device engaging an adjacent pusher upon the removal of the at least one divider.

2. The merchandise pusher system of claim 1 wherein the housing further includes a top wall and a bottom wall, the at least one divider extending between the top wall and the bottom wall.

3. The merchandise pusher system of claim 1 wherein the at least one removable divider is a plurality of dividers with each divider positioned between adjacent biased pushers.

4. The merchandise pusher system of claim 1 wherein the housing further includes a removable front product retaining wall.

5. The merchandise pusher system of claim 1 wherein the biased pusher includes opposing side walls and an opening located in at least one of the side walls.

6. The merchandise pusher system of claim 5 wherein the at least one interlocking device extends through the opening upon the removal of the at least one divider.

7. The merchandise pusher system of claim 6 wherein the at least one interlocking device retracts from the opening upon the insertion of the at least one divider.

8. The merchandise pusher system of claim 1 wherein each of the plurality of biased pushers include a biasing mechanism operatively coupled to the top end and the bottom end of each pusher for permitting independent biasing of either of the top end or the bottom end of the pusher.

9. The merchandise pusher system of claim 8 wherein the biasing mechanism includes the use of a flat coiled spring defining a releasably secured end and a coiled end.

10. A method of self-facing product in a retail store comprising the steps of:

providing a housing defining a front and a back and containing a plurality of product channels, the housing including a plurality of pushers and at least one removable divider positioned between the plurality of pushers, the pushers biasing the product toward the front of the housing, the plurality of pushers further including at least one interlocking device, placing product in the plurality of product channels, and removing the at least one divider thereby causing the at least one interlocking device to engage an adjacent pusher and to cause adjacent pushers to bias in unison toward the front of the housing.

11. The method of self-facing product of claim 10 further comprising the steps of replacing the at least one divider thereby causing the at least one interlocking device to disengage from the adjacent pusher.

12. The method of self-facing product of claim 10 wherein the pushers define opposing side walls and at least one opening for receiving the at least one interlocking device from the adjacent pusher.

13. The method of self-facing product of claim 10 wherein the step of removing the at least one divider includes sliding the divider between the plurality of pushers.

14. A system for merchandising product in a retail store comprising:

a housing containing a plurality of product channels separated by a plurality of removable dividers, and a plurality of pushers positioned within the housing with one pusher positioned within one product channel, each of the plurality of pushers having a top end and a bottom end, a biasing mechanism is operatively coupled to the top end and the bottom end of each pusher for permitting independent biasing of either of the top end or the bottom end of the pusher, the plurality of pushers being adaptable to receive an interlocking device for operatively coupling adjacent pushers upon the insertion or removal of one of the plurality of dividers.

15. The system of claim 14 wherein the housing further include s a removable front product retaining wall.

16. The system of claim 15 wherein the interlocking device may include a pivoting mechanism connected to the pusher.

17. The system of claim 16 wherein the pusher includes an opening for receiving a pivoting mechanism of an adjacent pusher.

18. The system of claim 17 wherein the housing includes a plurality of slots, the plurality of removable divider s slidably engaging the plurality of slots.

19. The system of claim 15 wherein the biasing mechanism includes a coiled spring.

20. The system of claim 19 wherein the coiled spring further includes a first end that releasably engages the housing and a second coiled end that abuts one of the plurality of pushers.

* * * * *

UNITED STATES PATENT AND TRADEMARK OFFICE

CERTIFICATE OF CORRECTION

PATENT NO. : 6,824,009 B2
APPLICATION NO. : 10/248881
DATED : November 30, 2004
INVENTOR(S) : Stephen Neal Hardy It is certified that error appears in the above-identified patent and that said Letters Patent is hereby corrected as shown below:

In Column 2, at line 44, replace the word “attach ed” with --attached--

In Column 8, at line 13, replace the word “include s” with --includes--

In Column 8, at line 20, replace the word “divider s” with --dividers--

Signed and Sealed this

Eighth Day of January, 2008

JON W. DUDAS
*Director of the United States Patent and Trademark Office*